US010979838B2

(12) United States Patent
Donley et al.

(10) Patent No.: US 10,979,838 B2
(45) Date of Patent: Apr. 13, 2021

(54) POWER REDUCTION VIA SMART MICROPHONE SELECTION USING ENVIRONMENTAL INTELLIGENCE

(71) Applicant: Facebook Technologies, LLC, Menlo Park, CA (US)

(72) Inventors: Jacob Ryan Donley, Kirkland, WA (US); Andrew Lovitt, Redmond, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/523,825

(22) Filed: Jul. 26, 2019

(65) Prior Publication Data

US 2021/0029479 A1 Jan. 28, 2021

(51) Int. Cl.

| | |
|---|---|
| ***H04R 29/00*** | (2006.01) |
| ***H04R 1/40*** | (2006.01) |
| ***H04R 3/00*** | (2006.01) |
| ***G10L 25/30*** | (2013.01) |
| ***G10L 25/51*** | (2013.01) |

(52) U.S. Cl.
CPC ..... *H04R 29/005* (2013.01); *G10L 25/30* (2013.01); *G10L 25/51* (2013.01); *H04R 1/406* (2013.01); *H04R 3/005* (2013.01)

(58) Field of Classification Search
CPC ..... H04R 29/005; H04R 1/406; H04R 3/005; G10L 25/30; G10L 25/51
USPC ..... 381/56
See application file for complete search history.

(56) References Cited

U.S. PATENT DOCUMENTS

2015/0341734 A1* 11/2015 Sherman ..... H04R 1/406 381/92
2018/0317002 A1 11/2018 Castillo et al.

OTHER PUBLICATIONS

PCT International Search Report and Written Opinion, PCT Application No. PCT/US2020/042595, dated Jan. 11, 2021, 18 pages.

* cited by examiner

*Primary Examiner* — Paul Kim
*Assistant Examiner* — Douglas J Suthers
(74) *Attorney, Agent, or Firm* — Fenwick & West LLP

(57) ABSTRACT

A system reduces power consumption by optimizing a selection of acoustic sensors of a sensor array based on environmental parameters of a local area. The system includes the sensor array including the acoustic sensors configured to detect sound in a local area, and processing circuitry. The processing circuitry is configured to: determine an environmental parameter of the local area; determine a performance metric for the sensor array; determine a selection of a subset of acoustic sensors from the acoustic sensors of the sensor array that satisfies the performance metric based on the environmental parameter of the local area; and process audio data from the subset of the acoustic sensors of the sensor array.

20 Claims, 6 Drawing Sheets

POWER REDUCTION VIA SMART MICROPHONE SELECTION USING ENVIRONMENTAL INTELLIGENCE

BACKGROUND

The present disclosure generally relates to acoustic sensor arrays and specifically to optimization of sensor array usage using environmental intelligence.

Energy limitations and heat dissipation are challenges for wearable devices, and can make it difficult to implement certain types of functionality on the wearable devices. Microphone array processing, for example, uses a sensor array that consumes power to capture audio data and real-time process heavy algorithms to process the audio data. It is desirable to reduce power consumption and processing requirements while achieving a sufficient level of performance.

SUMMARY

Embodiments relate to using environmental parameters as a basis for selecting an optimal subset of acoustic sensors from a sensor array to reduce power consumption while maintaining high performance, such as in terms of satisfying performance metrics related to the sensor array or audio processing. Some embodiments include a method, performed by an audio system, that determines an environmental parameter of a local area surrounding a sensor array. The sensor array includes acoustic sensors configured to detect sounds in the local area. A performance metric is determined for the sensor array, and a selection of a subset of acoustic sensors are determined from the acoustic sensors of the sensor array that satisfies the performance metric based on the environmental parameter of the local area. Audio data is processed from the subset of the acoustic sensors of the sensor array. Audio content presented by the audio system is based in part on the processed audio data Some embodiments include a system including a sensor array and an audio controller. The sensor array includes acoustic sensors configured to detect sound in a local area. The audio controller determines an environmental parameter of the local area and determines a performance metric for the sensor array. The audio controller determines a selection of a subset of acoustic sensors from the acoustic sensors of the sensor array that satisfies the performance metric based on the environmental parameter of the local area, and processes audio data from the subset of the acoustic sensors of the sensor array. Audio content presented by the system is based in part on the processed audio data.

Some embodiments include a non-transitory computer-readable medium storing instructions that, when executed by one or more processors, cause the one or more processors to determine an environmental parameter of a local area surrounding a sensor array including acoustic sensors configured to detect sounds in the local area and determine a performance metric for the sensor array. The instructions further cause the one or more processors to determine a selection of a subset of acoustic sensors from the acoustic sensors of the sensor array that satisfies the performance metric based on the environmental parameter of the local area, and process audio data from the subset of the acoustic sensors of the sensor array.

Figure 1A:
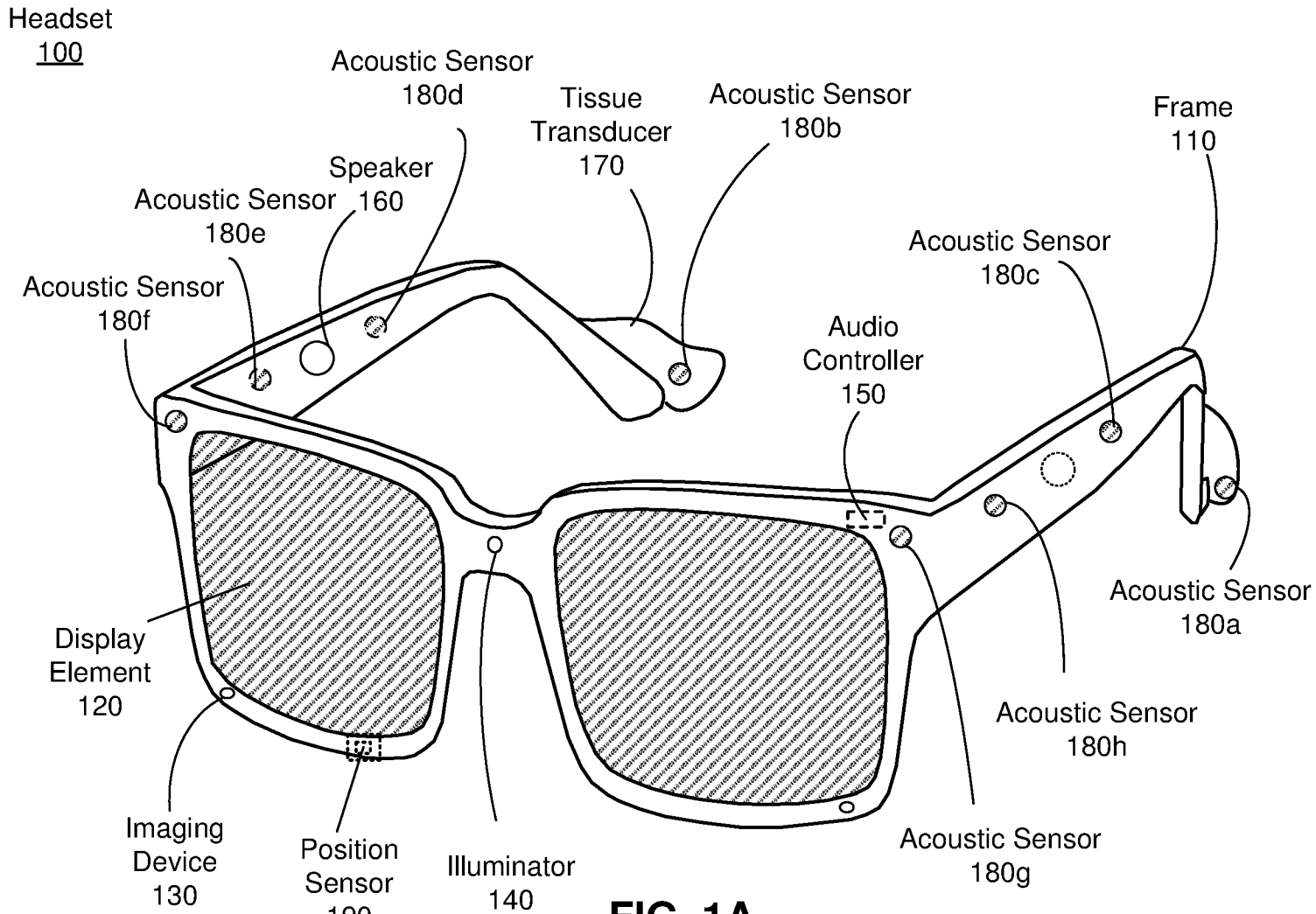
FIG. 1A is a perspective view of a headset implemented as an eyewear device, in accordance with one or more embodiments.

The figures depict embodiments of the present disclosure for purposes of illustration only. One skilled in the art will readily recognize from the following description that alternative embodiments of the structures and methods illustrated herein may be employed without departing from the principles, or benefits touted, of the disclosure described herein.

DETAILED DESCRIPTION

Embodiments relate to reducing power consumption for sensor arrays employed in spatial sound applications using environmental intelligence. Environmental intelligence refers to information about the environment, as may be defined by environmental parameters captured by various types of sensors. For example, the environmental parameters of a local area surrounding a sensor array and target performance metrics are determined, and used as a basis for selecting an optimal subset of acoustic sensors from the sensor array. The environmental parameters may be determined based on data captured by the acoustic sensors or other types of sensors. The selection may include activating or deactivating acoustic sensors, or processing data from only the subset of acoustic sensors. As such, power consumption is reduced while maintaining a target (e.g., high) performance. In one example, an environmental parameter of the local area includes a reverberation time and a performance metric includes an array gain. A longer reverberation time corresponds with a larger number of activated acoustic sensors to achieve a target array gain. A selection of a subset of acoustic sensors of the sensor array that achieves the target array gain is determined based on the reverberation time of the local area.

Embodiments of the present disclosure may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a headset connected to a host computer system, a standalone headset, a mobile device or computing system, or any other hardware platform capable of providing artificial reality content to one or more viewers.

Eyewear Device Configuration

FIG. 1A is a perspective view of a headset 100 implemented as an eyewear device, in accordance with one or more embodiments. In some embodiments, the eyewear device is a near eye display (NED). In general, the headset 100 may be worn on the face of a user such that content (e.g., media content) is presented using a display assembly and/or an audio system. However, the headset 100 may also be used such that media content is presented to a user in a different manner. Examples of media content presented by the headset 100 include one or more images, video, audio, or some combination thereof. The headset 100 includes a frame, and may include, among other components, a display assembly including one or more display elements 120, a depth camera assembly (DCA), an audio system, and a position sensor 190. While FIG. 1A illustrates the components of the headset 100 in example locations on the headset 100, the components may be located elsewhere on the headset 100, on a peripheral device paired with the headset 100, or some combination thereof. Similarly, there may be more or fewer components on the headset 100 than what is shown in FIG. 1A.

The frame 110 holds the other components of the headset 100. The frame 110 includes a front part that holds the one or more display elements 120 and end pieces (e.g., temples) to attach to a head of the user. The front part of the frame 110 bridges the top of a nose of the user. The length of the end pieces may be adjustable (e.g., adjustable temple length) to fit different users. The end pieces may also include a portion that curls behind the ear of the user (e.g., temple tip, ear piece).

The one or more display elements 120 provide light to a user wearing the headset 100. As illustrated the headset includes a display element 120 for each eye of a user. In some embodiments, a display element 120 generates image light that is provided to an eyebox of the headset 100. The eyebox is a location in space that an eye of user occupies while wearing the headset 100. For example, a display element 120 may be a waveguide display. A waveguide display includes a light source (e.g., a two-dimensional source, one or more line sources, one or more point sources, etc.) and one or more waveguides. Light from the light source is in-coupled into the one or more waveguides which outputs the light in a manner such that there is pupil replication in an eyebox of the headset 100. In-coupling and/or outcoupling of light from the one or more waveguides may be done using one or more diffraction gratings. In some embodiments, the waveguide display includes a scanning element (e.g., waveguide, mirror, etc.) that scans light from the light source as it is in-coupled into the one or more waveguides. Note that in some embodiments, one or both of the display elements 120 are opaque and do not transmit light from a local area around the headset 100. The local area is the area surrounding the headset 100. For example, the local area may be a room that a user wearing the headset 100 is inside, or the user wearing the headset 100 may be outside and the local area is an outside area. In this context, the headset 100 generates VR content. Alternatively, in some embodiments, one or both of the display elements 120 are at least partially transparent, such that light from the local area may be combined with light from the one or more display elements to produce AR and/or MR content.

In some embodiments, a display element 120 does not generate image light, and instead is a lens that transmits light from the local area to the eyebox. For example, one or both of the display elements 120 may be a lens without correction (non-prescription) or a prescription lens (e.g., single vision, bifocal and trifocal, or progressive) to help correct for defects in a user's eyesight. In some embodiments, the display element 120 may be polarized and/or tinted to protect the user's eyes from the sun.

Note that in some embodiments, the display element 120 may include an additional optics block (not shown). The optics block may include one or more optical elements (e.g., lens, Fresnel lens, etc.) that direct light from the display element 120 to the eyebox. The optics block may, e.g., correct for aberrations in some or all of the image content, magnify some or all of the image, or some combination thereof.

The DCA determines depth information for a portion of a local area surrounding the headset 100. The DCA includes one or more imaging devices 130 and a DCA controller (not shown in FIG. 1A), and may also include an illuminator 140. In some embodiments, the illuminator 140 illuminates a portion of the local area with light. The light may be, e.g., structured light (e.g., dot pattern, bars, etc.) in the infrared (IR), IR flash for time-of-flight, etc. In some embodiments, the one or more imaging devices 130 capture images of the portion of the local area that include the light from the illuminator 140. As illustrated, FIG. 1A shows a single illuminator 140 and two imaging devices 130. In alternate embodiments, there is no illuminator 140 and at least two imaging devices 130.

The DCA controller computes depth information for the portion of the local area using the captured images and one or more depth determination techniques. The depth determination technique may be, e.g., direct time-of-flight (ToF) depth sensing, indirect ToF depth sensing, structured light, passive stereo analysis, active stereo analysis (uses texture added to the scene by light from the illuminator 140), some other technique to determine depth of a scene, or some combination thereof.

The audio system provides audio content. The audio system includes a transducer array, a sensor array, and an audio controller 150. However, in other embodiments, the audio system may include different and/or additional components. Similarly, in some cases, functionality described with reference to the components of the audio system can be distributed among the components in a different manner than is described here. For example, some or all of the functions of the controller may be performed by a remote server.

The transducer array presents sound to user. The transducer array includes a plurality of transducers. A transducer may be a speaker 160 (e.g., an acoustic transducer) or a tissue transducer 170 (e.g., a bone conduction transducer or a cartilage conduction transducer). Although the speakers 160 are shown exterior to the frame 110, the speakers 160 may be enclosed in the frame 110. In some embodiments, instead of individual speakers for each ear, the headset 100 includes a speaker array comprising multiple speakers integrated into the frame 110 to improve directionality of presented audio content. The tissue transducer 170 couples to the head of the user and directly vibrates tissue (e.g., bone or cartilage) of the user to generate sound. The number and/or locations of transducers may be different from what is shown in FIG. 1A.

The sensor array detects sounds within the local area of the headset 100. The sensor array includes a plurality of acoustic sensors 180*a-h* (each referred to as an acoustic sensor 180). An acoustic sensor 180 captures sounds emitted from one or more sound sources in the local area (e.g., a room). Each acoustic sensor is configured to detect sound and convert the detected sound into an electronic format (analog or digital). The acoustic sensors 180 may be acoustic wave sensors, microphones, sound transducers, or similar sensors that are suitable for detecting sounds. The sensor array may dynamically activate or deactivate each acoustic sensor 180 in accordance with instructions from the audio controller 150. Activating an acoustic sensor 180 results the acoustic sensor 180 in an active state and deactivating an acoustic sensor 180 results in the acoustic sensor 180 being in an inactive state. In some embodiments, an acoustic sensor 180 is powered on in the active state and powered off in the inactive state.

In some embodiments, one or more acoustic sensors 180 may be placed in an ear canal of each ear (e.g., acting as binaural microphones). An acoustic sensor 180 may be placed in the ear canal along with a transducer. In some embodiments, the acoustic sensors 180 may be placed on an exterior surface of the headset 100, placed on an interior surface of the headset 100, separate from the headset 100 (e.g., part of some other device), or some combination thereof. The number and/or locations of acoustic sensors 180 may be different from what is shown in FIG. 1A. For example, the number of acoustic detection locations may be increased to increase the amount of audio information collected and the sensitivity and/or accuracy of the information. The acoustic detection locations may be oriented such that the microphone is able to detect sounds in a wide range of directions surrounding the user wearing the headset 100.

The audio controller 150 processes information from the sensor array that describes sounds detected by the sensor array. The audio controller 150 may comprise a processor and a computer-readable storage medium. The audio controller 150 may be configured to generate direction of arrival (DOA) estimates, generate acoustic transfer functions (e.g., array transfer functions and/or head-related transfer functions), track the location of sound sources, form beams in the direction of sound sources, classify sound sources, generate sound filters for the speakers 160, or some combination thereof.

The audio controller 150 detects sound to generate one or more acoustic transfer functions for a user. An acoustic transfer function characterizes how a sound is received from a point in space. The acoustic transfer functions may be array transfer functions (ATFs), head-related transfer functions (HRTFs), other types of acoustic transfer functions, or some combination thereof. The one or more acoustic transfer functions may be associated with the headset 100, the user wearing the headset 100, or both. The audio controller 150 may then use the one or more acoustic transfer functions to generate audio content for the user.

The audio controller 150 generates instructions for activating and deactivating various acoustic sensors 180 of the sensor array. The instructions may be generated based on environmental parameters captured by the sensor array or other sensor (e.g., imaging device 130, position sensor 190, etc.) of the headset 100 and target performance metrics.

The configuration of the acoustic sensors 180 of the sensor array may vary. While the headset 100 is shown in FIG. 1A as having eight acoustic sensors 180, the number of acoustic sensors 180 may be increased or decreased. Increasing the number of acoustic sensors 180 may increase the amount of audio information collected and the sensitivity and/or accuracy of the audio information. Decreasing the number of acoustic sensors 180 may decrease the computing power required by the audio controller 150 to process the collected audio information, or decrease the power consumption of the headset 100. In addition, the position of each acoustic sensor 180 of the sensor array may vary. The position of an acoustic sensor 180 may include a defined position on the user, a defined coordinate on the frame 110, an orientation associated with each acoustic sensor, or some combination thereof. For example, the acoustic sensors 180*a*, 180*b* may be positioned on a different part of the user's ear, such as behind the pinna or within the auricle or fossa, or there may be additional acoustic sensors on or surrounding the ear in addition to the acoustic sensors 180 inside the ear canal. Having an acoustic sensor (e.g., acoustic sensors 180*a*, 180*b*) positioned next to an ear canal of a user enables the sensor array to collect information on how sounds arrive at the ear canal. The acoustic sensors 180 on the frame 110 may be positioned along the length of the temples, across the bridge, above or below the display element 120, or some combination thereof. The acoustic sensors 180 may be oriented such that the sensor array is able to detect sounds in a wide range of directions surrounding the user wearing the headset 100.

The audio controller 150 processes information from the sensor array that describes sounds detected by the sensor array. The information associated with each detected sound may include a frequency, an amplitude, and/or a duration of the detected sound. For a detected sound, the audio controller 150 may perform a DoA estimation. The DoA estimation is an estimated direction from which the detected sound arrived at an acoustic sensor 180 of the sensor array. If a sound is detected by at least two acoustic sensors 180 of the sensor array, the audio controller 150 can use the known positional relationship of the acoustic sensors 180 and the DoA estimation from each acoustic sensor to estimate a source location or direction of the detected sound, for example, via triangulation. The accuracy of the source location estimation may increase as the number of acoustic sensors 180 that detected the sound increases and/or as the distance between the acoustic sensors 180 that detected the sound increases.

In some embodiments, the audio controller 150 populates an audio data set with information. The information may include a detected sound and parameters associated with each detected sound. Example parameters may include a frequency, an amplitude, a duration, a DoA estimation, a source location, or some combination thereof. Each audio data set may correspond to a different source location relative to the headset 110 and include one or more sounds having that source location. This audio data set may be associated with one or more acoustic transfer functions for that source location. The one or more acoustic transfer functions may be stored in the data set. In alternate embodiments, each audio data set may correspond to several source locations relative to the headset 110 and include one or more sounds for each source location. For example, source locations that are located relatively near to each other may be grouped together. The audio controller 150 may populate the audio data set with information as sounds are detected by the sensor array. The audio controller 150 may further populate the audio data set for each detected sound as a DoA estimation is performed or a source location is determined for each detected sound.

In some embodiments, the audio controller 150 selects the detected sounds for which it performs a DoA estimation. The audio controller 150 may select the detected sounds based on the parameters associated with each detected sound stored in the audio data set. The audio controller 150 may evaluate the stored parameters associated with each detected sound and determine if one or more stored parameters meet a corresponding parameter condition. For example, a parameter condition may be met if a parameter is above or below a threshold value or falls within a target range. If a parameter condition is met, the audio controller 150 performs a DoA estimation for the detected sound. For example, the audio controller 150 may perform a DoA estimation for detected sounds that have a frequency within a frequency range, an amplitude above a threshold amplitude, a duration below a threshold duration, other similar variations, or some combination thereof. Parameter conditions may be set by a user of the audio system, based on historical data, based on an analysis of the information in the audio data set (e.g., evaluating the collected information of the parameter and setting an average), or some combination thereof. The audio controller 150 may create an element in the audio set to store the DoA estimation and/or source location of the detected sound. In some embodiments, the audio controller 150 may update the elements in the audio set if data is already present.

In some embodiments, the audio controller 150 may receive position information of the headset 100 from a system external to the headset 100. The position information may include a location of the headset 100, an orientation of the headset 100 or the user's head wearing the headset 100, or some combination thereof. The position information may be defined relative to a reference point. The orientation may correspond to a position of each ear relative to the reference point. Examples of systems include an imaging assembly, a console (e.g., as described in FIG. 7), a simultaneous localization and mapping (SLAM) system, a depth camera assembly, a structured light system, or other suitable systems. In some embodiments, the headset 100 may include sensors that may be used for SLAM calculations, which may be carried out in whole or in part by the audio controller 150. The audio controller 150 may receive position information from the system continuously or at random or specified intervals.

In one embodiment, based on parameters of the detected sounds, the audio controller 150 generates one or more acoustic transfer functions. The acoustic transfer functions may be array transfer functions (ATFs), head-related transfer functions (HRTFs), other types of acoustic transfer functions, or some combination thereof. An ATF characterizes how the sensor array receives a sound from a point in space. Specifically, the ATF defines the relationship between parameters of a sound at its source location and the parameters at which the sensor array detected the sound. Parameters associated with the sound may include frequency, amplitude, duration, a DoA estimation, etc. In some embodiments, at least some of the acoustic sensors of the sensor array are coupled to the headset 100 that is worn by a user. The ATF for a particular source location relative to the sensor array may differ from user to user due to a person's anatomy (e.g., ear shape, shoulders, etc.) that affects the sound as it travels to the person's ears. Accordingly, the ATFs of the sensor array are personalized for each user wearing the headset 100. Once the ATFs are generated, the ATFs may be stored in local or external memory.

The HRTF characterizes how an ear receives a sound from a point in space. The HRTF for a particular source location relative to a person is unique to each ear of the person (and is unique to the person) due to the person's anatomy (e.g., ear shape, shoulders, etc.) that affects the sound as it travels to the person's ears. For example, in FIG. 1, the audio controller 150 may generate two HRTFs for the user, one for each ear. An HRTF or a pair of HRTFs can be used to create audio content that includes sounds that seem to come from a specific point in space. Several HRTFs may be used to create surround sound audio content (e.g., for home entertainment systems, theater speaker systems, an immersive environment, etc.), where each HRTF or each pair of HRTFs corresponds to a different point in space such that audio content seems to come from several different points in space. In some embodiments, the audio controller 150 may update one or more pre-existing acoustic transfer functions based on the DoA estimation of each detected sound. The pre-existing acoustic transfer functions may be obtained from local or external memory or obtained from an external system. As the position of the headset 100 changes within the local area, the audio controller 150 may generate a new acoustic transfer function or update a pre-existing acoustic transfer function accordingly. Once the HRTFs are generated, the HRTFs may be stored in local or external memory.

The position sensor 190 generates one or more measurement signals in response to motion of the headset 100. The position sensor 190 may be located on a portion of the frame 110 of the headset 100. The position sensor 190 may include an inertial measurement unit (IMU). Examples of position sensor 190 include: one or more accelerometers, one or more gyroscopes, one or more magnetometers, another suitable type of sensor that detects motion, a type of sensor used for error correction of the IMU, or some combination thereof. The position sensor 190 may be located external to the IMU, internal to the IMU, or some combination thereof.

In some embodiments, the headset 100 may provide for simultaneous localization and mapping (SLAM) for a position of the headset 100 and updating of a model of the local area. For example, the headset 100 may include a passive camera assembly (PCA) that generates color image data. The PCA may include one or more RGB cameras that capture images of some or all of the local area. In some embodiments, some or all of the imaging devices 130 of the DCA may also function as the PCA. The images captured by the PCA and the depth information determined by the DCA may be used to determine parameters of the local area, generate a model of the local area, update a model of the local area, or some combination thereof. Furthermore, the position sensor 190 tracks the position (e.g., location and pose) of the headset 100 within the room. Additional details regarding the components of the headset 100 are discussed below in connection with FIG. 5.

Figure 1B:
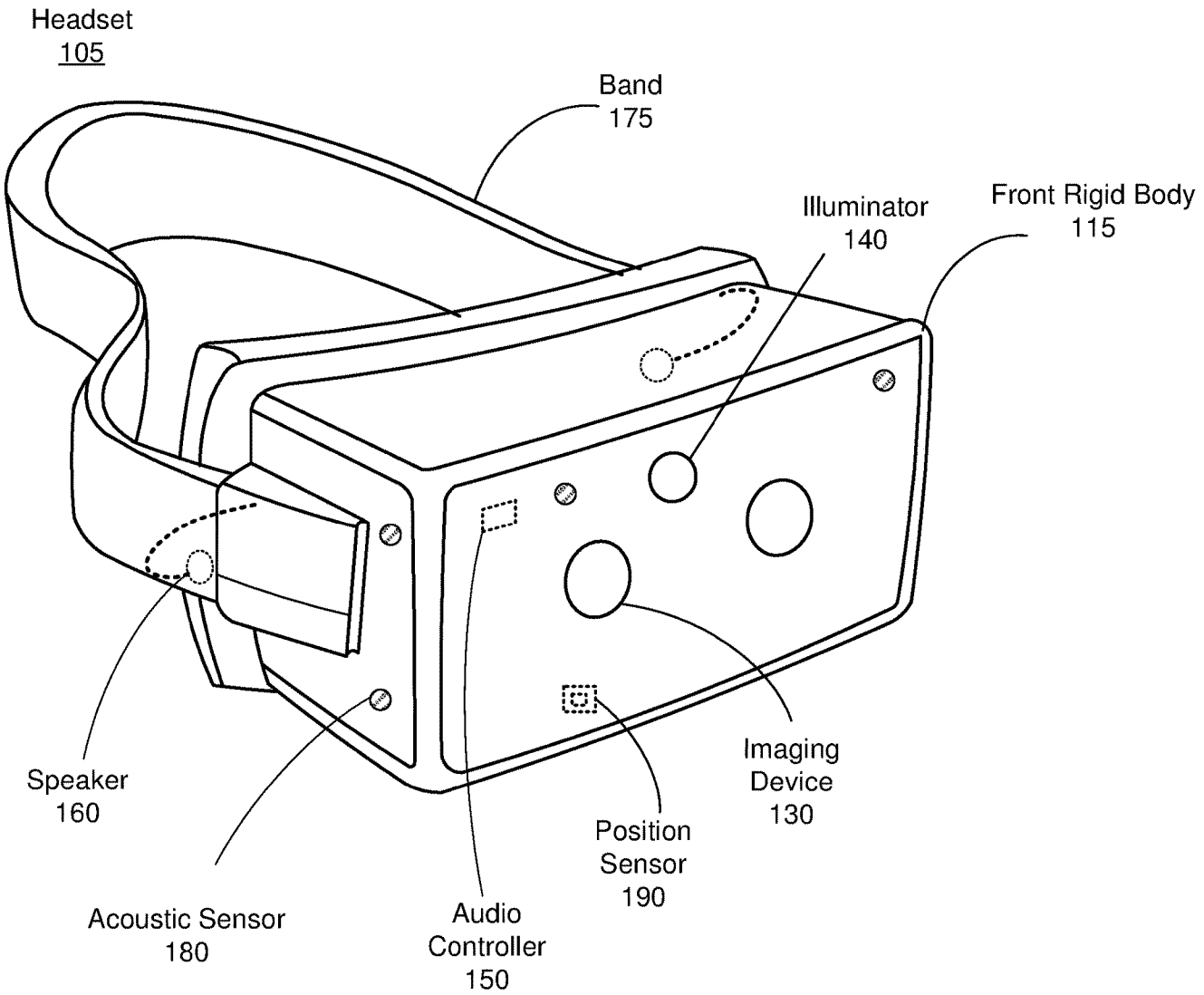
FIG. 1B is a perspective view of a headset implemented as a head-mounted display, in accordance with one or more embodiments.

FIG. 1B is a perspective view of a headset 105 implemented as a HMD, in accordance with one or more embodiments. In embodiments that describe an AR system and/or a MR system, portions of a front side of the HMD are at least partially transparent in the visible band (~380 nm to 750 nm), and portions of the HMD that are between the front side of the HMD and an eye of the user are at least partially transparent (e.g., a partially transparent electronic display). The HMD includes a front rigid body 115 and a band 175. The headset 105 includes many of the same components described above with reference to FIG. 1A, but modified to integrate with the HMD form factor. For example, the HMD includes a display assembly, a DCA, an audio system, and a position sensor 190. FIG. 1B shows the illuminator 140, a plurality of the speakers 160, a plurality of the imaging devices 130, a plurality of acoustic sensors 180, and the position sensor 190.

Audio System Overview

Figure 2:
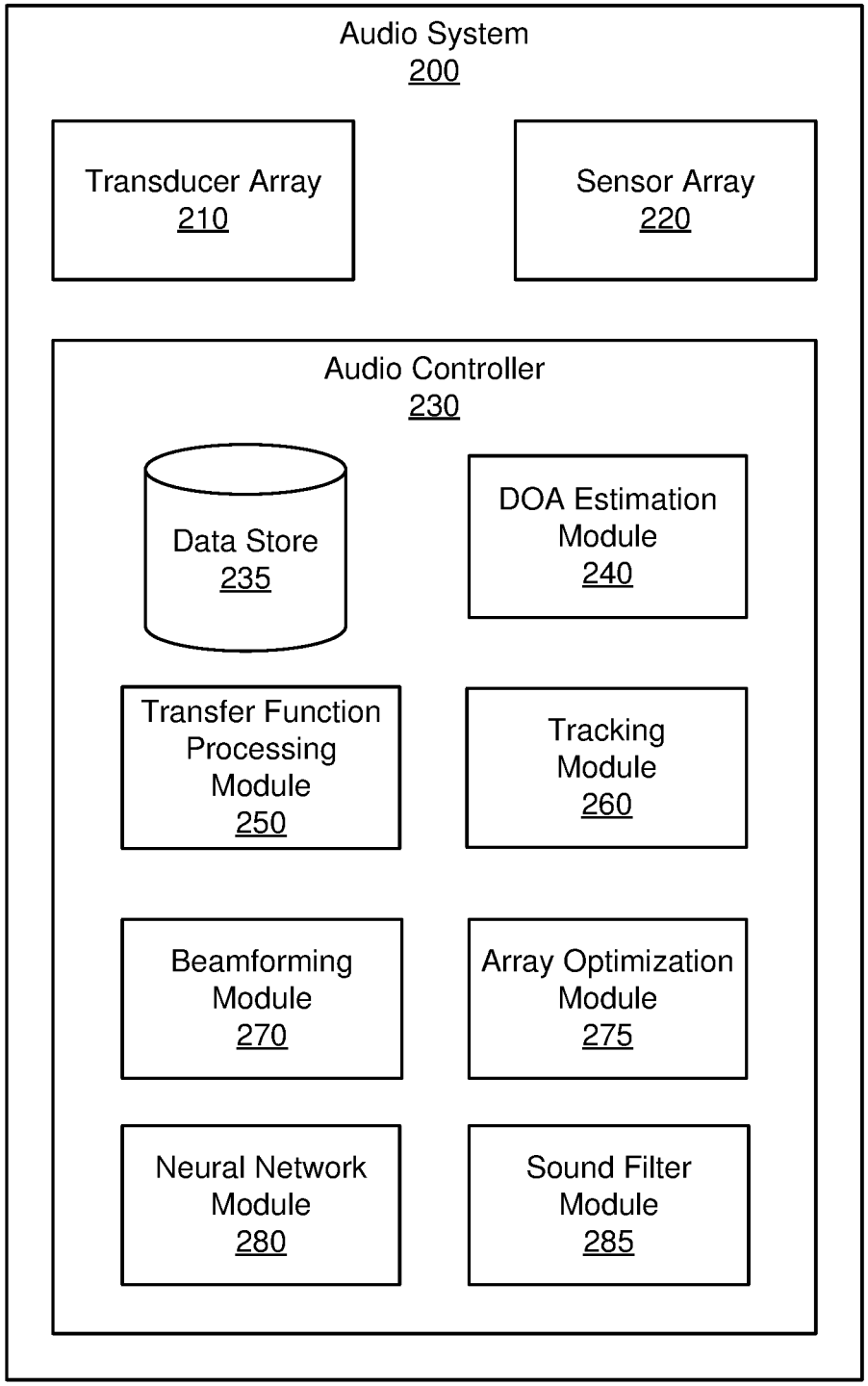
FIG. 2 is a block diagram of an audio system, in accordance with one or more embodiments.

FIG. 2 is a block diagram of an audio system 200, in accordance with one or more embodiments. The audio system in FIG. 1A or FIG. 1B may be an embodiment of the audio system 200. The audio system 200 generates one or more acoustic transfer functions for a user. The audio system 200 may then use the one or more acoustic transfer functions to generate audio content for the user. In the embodiment of FIG. 2, the audio system 200 includes a transducer array 210, a sensor array 220, and an audio controller 230. Some embodiments of the audio system 200 have different components than those described here. Similarly, in some cases, functions can be distributed among the components in a different manner than is described here.

The transducer array 210 is configured to present audio content. The transducer array 210 includes a plurality of transducers. A transducer is a device that provides audio content. A transducer may be, e.g., a speaker (e.g., the speaker 160), a tissue transducer (e.g., the tissue transducer 170), some other device that provides audio content, or some combination thereof. A tissue transducer may be configured to function as a bone conduction transducer or a cartilage conduction transducer. The transducer array 210 may present audio content via air conduction (e.g., via one or more speakers), via bone conduction (via one or more bone conduction transducer), via cartilage conduction audio system (via one or more cartilage conduction transducers), or some combination thereof. In some embodiments, the transducer array 210 may include one or more transducers to cover different parts of a frequency range. For example, a piezoelectric transducer may be used to cover a first part of a frequency range and a moving coil transducer may be used to cover a second part of a frequency range.

The bone conduction transducers generate acoustic pressure waves by vibrating bone/tissue in the user's head. A bone conduction transducer may be coupled to a portion of a headset, and may be configured to be behind the auricle coupled to a portion of the user's skull. The bone conduction transducer receives vibration instructions from the audio controller 230, and vibrates a portion of the user's skull based on the received instructions. The vibrations from the bone conduction transducer generate a tissue-borne acoustic pressure wave that propagates toward the user's cochlea, bypassing the eardrum.

The cartilage conduction transducers generate acoustic pressure waves by vibrating one or more portions of the auricular cartilage of the ears of the user. A cartilage conduction transducer may be coupled to a portion of a headset, and may be configured to be coupled to one or more portions of the auricular cartilage of the ear. For example, the cartilage conduction transducer may couple to the back of an auricle of the ear of the user. The cartilage conduction transducer may be located anywhere along the auricular cartilage around the outer ear (e.g., the pinna, the tragus, some other portion of the auricular cartilage, or some combination thereof). Vibrating the one or more portions of auricular cartilage may generate: airborne acoustic pressure waves outside the ear canal; tissue born acoustic pressure waves that cause some portions of the ear canal to vibrate thereby generating an airborne acoustic pressure wave within the ear canal; or some combination thereof. The generated airborne acoustic pressure waves propagate down the ear canal toward the ear drum.

The transducer array 210 generates audio content in accordance with instructions from the audio controller 230. In some embodiments, the audio content is spatialized. Spatialized audio content is audio content that appears to originate from a particular direction and/or target region (e.g., an object in the local area and/or a virtual object). For example, spatialized audio content can make it appear that sound is originating from a virtual singer across a room from a user of the audio system 200. The transducer array 210 may be coupled to a wearable device (e.g., the headset 100 or the headset 105). In alternate embodiments, the transducer array 210 may be a plurality of speakers that are separate from the wearable device (e.g., coupled to an external console).

The sensor array 220 detects sounds within a local area surrounding the sensor array 220. The sensor array 220 may include a plurality of acoustic sensors that each detect air pressure variations of a sound wave and convert the detected sounds into an electronic format (analog or digital). The plurality of acoustic sensors may be positioned on a headset (e.g., headset 100 and/or the headset 105), on a user (e.g., in an ear canal of the user), on a neckband, or some combination thereof. An acoustic sensor may be, e.g., a microphone, a vibration sensor, an accelerometer, or any combination thereof. In some embodiments, the sensor array 220 is configured to monitor the audio content generated by the transducer array 210 using at least some of the plurality of acoustic sensors. Increasing the number of sensors may improve the accuracy of information (e.g., directionality) describing a sound field produced by the transducer array 210 and/or sound from the local area. The sensor array 220 may dynamically activate or deactivate each acoustic sensor in accordance with instructions from the audio controller 230.

The audio controller 230 includes a processing circuitry that controls operation of the audio system 200. In the embodiment of FIG. 2, the audio controller 230 includes a data store 235, a DOA estimation module 240, a transfer function processing module 250, a tracking module 260, a beamforming module 270, an array optimization module 275, a neural network module 280 and a sound filter module 285. The audio controller 230 may be located inside a headset, in some embodiments. Some embodiments of the audio controller 230 have different components than those described here. Similarly, functions can be distributed among the components in different manners than described here. For example, some functions of the controller may be performed external to the headset.

The data store 235 stores data for use by the audio system 200. Data in the data store 235 may include environmental parameters of a local area, target performance metrics of the audio system, activated and inactivated acoustic sensors of the sensor array 230, sounds recorded in the local area of the audio system 200, audio content, head-related transfer functions (HRTFs), transfer functions for one or more sensors, array transfer functions (ATFs) for one or more of the acoustic sensors, sound source locations, virtual model of local area, direction of arrival estimates, sound filters, and other data relevant for use by the audio system 200, environmental parameters of a local area surrounding the sensor array 220, selected or otherwise determined performance metrics, optimized subsets of activated and deactivated acoustic sensors, or any combination thereof.

The DOA estimation module 240 is configured to localize sound sources in the local area based in part on information from the sensor array 220. Localization is a process of determining where sound sources are located relative to the user of the audio system 200. The DOA estimation module 240 performs a DOA analysis to localize one or more sound sources within the local area. The DOA analysis may include analyzing the intensity, spectra, and/or arrival time of each sound at the sensor array 220 to determine the direction from which the sounds originated. In some cases, the DOA analysis may include any suitable algorithm for analyzing a surrounding acoustic environment in which the audio system 200 is located.

For example, the DOA analysis may be designed to receive input signals from the sensor array 220 and apply digital signal processing algorithms to the input signals to estimate a direction of arrival. These algorithms may include, for example, delay and sum algorithms where the input signal is sampled, and the resulting weighted and delayed versions of the sampled signal are averaged together to determine a DOA. A least mean squared (LMS) algorithm may also be implemented to create an adaptive filter. This adaptive filter may then be used to identify differences in signal intensity, for example, or differences in time of arrival. These differences may then be used to estimate the DOA. In another embodiment, the DOA may be determined by converting the input signals into the frequency domain and selecting specific bins within the time-frequency (TF) domain to process. Each selected TF bin may be processed to determine whether that bin includes a portion of the audio spectrum with a direct path audio signal. Those bins having a portion of the direct-path signal may then be analyzed to identify the angle at which the sensor array 220 received the direct-path audio signal. The determined angle may then be used to identify the DOA for the received input signal. Other algorithms not listed above may also be used alone or in combination with the above algorithms to determine DOA.

In some embodiments, the DOA estimation module 240 may also determine the DOA with respect to an absolute position of the audio system 200 within the local area. The position of the sensor array 220 may be received from an external system (e.g., some other component of a headset, an artificial reality console, a mapping server, a position sensor (e.g., the position sensor 190), etc.). The external system may create a virtual model of the local area, in which the local area and the position of the audio system 200 are mapped. The received position information may include a location and/or an orientation of some or all of the audio system 200 (e.g., of the sensor array 220). The DOA estimation module 240 may update the estimated DOA based on the received position information.

The transfer function processing module 250 is configured to generate one or more acoustic transfer functions. Generally, a transfer function is a mathematical function giving a corresponding output value for each possible input value. Based on parameters of the detected sounds, the transfer function processing module 250 generates one or more acoustic transfer functions associated with the audio system. The acoustic transfer functions may be array transfer functions (ATFs), head-related transfer functions (HRTFs), other types of acoustic transfer functions, or some combination thereof. An ATF characterizes how the microphone receives a sound from a point in space.

An ATF includes a number of transfer functions that characterize a relationship between the sound sounds and the corresponding sound received by the acoustic sensors in the sensor array 220. Accordingly, for a sound source there is a corresponding transfer function for each of the acoustic sensors in the sensor array 220. And collectively the set of transfer functions is referred to as an ATF. Accordingly, for each sound source there is a corresponding ATF. Note that the sound source may be, e.g., someone or something generating sound in the local area, the user, or one or more transducers of the transducer array 210. The ATF for a particular sound source location relative to the sensor array 220 may differ from user to user due to a person's anatomy (e.g., ear shape, shoulders, etc.) that affects the sound as it travels to the person's ears. Accordingly, the ATFs of the sensor array 220 are personalized for each user of the audio system 200.

In some embodiments, the transfer function processing module 250 determines one or more HRTFs for a user of the audio system 200. The HRTF characterizes how an ear receives a sound from a point in space. The HRTF for a particular source location relative to a person is unique to each ear of the person (and is unique to the person) due to the person's anatomy (e.g., ear shape, shoulders, etc.) that affects the sound as it travels to the person's ears. In some embodiments, the transfer function processing module 250 may determine HRTFs for the user using a calibration process. In some embodiments, the transfer function processing module 250 may provide information about the user to a remote system. The remote system determines a set of HRTFs that are customized to the user using, e.g., machine learning, and provides the customized set of HRTFs to the audio system 200.

The tracking module 260 is configured to track locations of one or more sound sources. The tracking module 260 may compare current DOA estimates and compare them with a stored history of previous DOA estimates. In some embodiments, the audio system 200 may recalculate DOA estimates on a periodic schedule, such as once per second, or once per millisecond. The tracking module may compare the current DOA estimates with previous DOA estimates, and in response to a change in a DOA estimate for a sound source, the tracking module 260 may determine that the sound source moved. In some embodiments, the tracking module 260 may detect a change in location based on visual information received from the headset or some other external source. The tracking module 260 may track the movement of one or more sound sources over time. The tracking module 260 may store values for a number of sound sources and a location of each sound source at each point in time. In response to a change in a value of the number or locations of the sound sources, the tracking module 260 may determine that a sound source moved. The tracking module 260 may calculate an estimate of the localization variance. The localization variance may be used as a confidence level for each determination of a change in movement.

The beamforming module 270 is configured to process one or more ATFs to selectively emphasize sounds from sound sources within a certain area while de-emphasizing sounds from other areas. In analyzing sounds detected by the sensor array 220, the beamforming module 270 may combine information from different acoustic sensors to emphasize sound associated from a particular region of the local area while deemphasizing sound that is from outside of the region. The beamforming module 270 may isolate an audio signal associated with sound from a particular sound source from other sound sources in the local area based on, e.g., different DOA estimates from the DOA estimation module 240 and the tracking module 260. The beamforming module 270 may thus selectively analyze discrete sound sources in the local area. In some embodiments, the beamforming module 270 may enhance a signal from a sound source. For example, the beamforming module 270 may apply sound filters which eliminate signals above, below, or between certain frequencies. Signal enhancement acts to enhance sounds associated with a given identified sound source relative to other sounds detected by the sensor array 220.

The array optimization module 275 optimizes the active set of acoustic sensors in the sensor array 220. All or a subset of the acoustic sensors in the sensor array 205 may be active to detect sounds. The array optimization module 275 may determine environmental parameters of a local area surrounding the sensor array 220, and determine performance metrics of the sensor array 220. The array optimization module 275 determines a selection of a subset of acoustic sensors from the acoustic sensors of the sensor array 220 that satisfies the performance metrics based on the environmental parameters. In one example, an environmental parameter of the local area includes a reverberation time and a performance metric includes an array gain. The array optimization module 275 determines a selection of a subset of acoustic sensors from the acoustic sensors of the sensor array 220 that achieves the target array gain based on the reverberation time of the local area. In general, a longer reverberation time requires a larger number of activated acoustic sensors to achieve a target array gain.

To optimize power consumption, the array optimization module 275 may determine a minimum number of acoustic sensors that can be used to satisfy the performance metrics given the parameters of the local area. The selected acoustic sensors of the sensor array 220 generate audio data, which is then processed by the audio controller 230. The selective activation and deactivation of acoustic sensors is discussed with regards to FIG. 3.

To determine the one or more environmental parameters, the sensor array 220 may detect sounds such as uncontrolled sounds or controlled sounds that occur in the local area. Controlled sounds include sounds generated by one or more transducers of the headset or some other device under control or otherwise in coordination with the audio controller 230, while uncontrolled sounds refer to sounds from the environment. In some embodiments, an environmental parameter of the local area may include a reverberation time. The reverberation time is defined as the time it takes for sound to decay, such as by 60 dB (e.g., RT60). The reverberation time may be measured in various ways. In one example, the local area is determined based on SLAM calculations to generate a model of the local area, and a simulation of sound propagation in the local area is performed to determine the reverberation time. In another example, the reverberation time may be determined based on measurement of sound by one or more acoustic sensors of the sensor array.

Other types of environmental parameters may also be used. In some embodiments, the environmental parameters of the local area may include an impulse response defining how sound is transformed when propagating from a sound source to a destination (e.g., the sensor array) in the local area. The impulse response may include direct sounds, early reflections, and late reverberations. In some embodiments, the environmental parameters of the local area may include parameters associated with sound sources in the local area. For example, the parameters may include the number of sound sources in the local area, the location or direction of arrival of the sound sources, or the signal-to-noise ratio of the sound sources. In some embodiments, the environmental parameters of the local area may include the loudness of background noise, a spatial property of background noise, the noise floor of the local area, materials and acoustic absorptions of surface of the local area, the frequency response in a direction, etc.

The environmental parameters of the local area may be determined by the audio system 200, such as based on receiving data from the acoustic sensors of the sensor array 220 or other types of sensors and performing calculations at array optimization module 275. In another example, the audio system 200 may receive (e.g., download) one or more of the environmental parameters from a remote system. For example, a remote system (e.g., mapping server 525 shown in FIG. 5) may store associations between local areas and environmental parameters. The audio system 200 may determine a location of the headset and generate a request to the remote system for the environmental parameters. In response, the server determines the environmental parameters based on the location, and provides the environmental parameters to the audio system 200.

A performance metric may define a level of performance or perceived performance that should be satisfied for audio data generated by the sensor array 220. Some examples of performance metrics may include signal-to-noise ratio (SNR), array gain, word error rate, distortion threshold level, distance for sound pick-up, white noise gain, signal to noise ratio of a beamformer, speech quality, speech intelligibility, or listening effort. The SNR defines ratio of the level of a target signal to the level of background noise. The array gain defines a ratio between an output SNR to an input SNR. Word error rate defines an accuracy of a speech recognition or machine translation algorithm. Distortion refers to deformation of a waveform of an audio source, and the distortion threshold level may define a threshold amount of permissible distortion. Distance for sound pick-up defines a maximum distance for a sound source that should be picked up by the sensor array. White noise gain or signal to noise ratio measures the ability to suppress spatially uncorrelated noise. Speech quality refers to a measure or estimate of the perceived quality of speech. Speech intelligibility refers to a measure or estimate of the number of words understood by a person. Listening effort refers to an amount of cognitive load a user undergoes when trying to understand words in a conversation.

In some embodiments, the performance metrics may be specified by a device separate from the headset including the audio system 200. For example, multiple users may each wear a headset in a local area. A first headset may determine a performance metric, and provide the performance metric to another headset that selects a subset of acoustic sensors based on the received performance metric.

By selecting an optimal subset of the acoustic sensors instead of utilizing all of the acoustic sensors of the sensor array 220, the array optimization module 275 reduces power consumption while maintaining high performance in terms of satisfying the performance metrics. Power consumption can be reduced by selective activation or deactivation of the acoustic sensors, by reducing the amount of audio data transmitted from the acoustic sensors to the audio controller 230 of the audio system 200, and/or by reducing the amount of audio data used by the audio controller 230 for processing. The array optimization module 275 determines the number of acoustic sensors that are used, as well as which ones of the acoustic sensors of the sensor array on the headset and/or neckband that are used and not used. To optimize power consumption, the array optimization module 275 may determine a minimum number of acoustic sensors that can be used to satisfy the performance metrics given the parameters of the local area. In general, a sound captured by acoustic sensors that are more spaced apart results in more differentiated audio data to facilitate DOA estimation or other types of spatialized audio processing. As such, the selection of the acoustic sensors may include optimizing the distance between activated acoustic sensors.

The neural network module 280 may determine the selection of the subset of acoustic sensors of the sensor array 220. The neural network module 280 may include processing circuitry, such as a graphics processing unit (GPU) or an application-specific integrated circuit (ASIC). In some embodiments, the processing circuitry is a component of the audio system 200. In other embodiments, the processing circuitry is separate from the audio system 200, such as in a remote system connected to the audio system 200 via a network or in a console. Here, the audio system 200 provides the neural network inputs to the remote system and receives the selected subset of the acoustic sensors from the remote system. The neural network module 280 implements a neural network including neural network layers and interconnections that define relationships between inputs including the environmental parameters of the local area and the performance metrics, and outputs including subsets of the acoustic sensors of the sensor array. The neural network receives the inputs and generates the outputs to control the operation of the audio system 200.

In some embodiments, a combination of heuristics and a neural network may be used to determine the subset of acoustic sensors. For example, a heuristic may be used to determine a local area type. A local area type defines a category of local area that include similar or the same environmental parameters. Different types of local areas, such as indoors, outdoors, room types, etc., may have different parameters (e.g., reverberation time), and thus determination of the local area type provides a clustering for selecting the subset of acoustic sensors. The local area type may be determined based on a model of the local area generated by a SLAM system, audio data from one or more of the acoustic sensors, user input, etc. The local area type may be used as an input to the neural network along with at least one of the one or more environmental parameters and the one or more performance metrics. The neural network outputs the subset of acoustic parameters that optimizes power consumption while satisfying the one or more performance metrics. In some embodiments, another heuristic may be applied to adjust the subset of acoustic sensors determined by the neural network. For example, one or more particular acoustic sensors may be activated based on the direction of a target sound source, or deactivated based on the direction of an undesired sound source.

The sound filter module 285 determines sound filters for the transducer array 210. In some embodiments, the sound filters cause the audio content to be spatialized, such that the audio content appears to originate from a target region. The sound filter module 285 may use HRTFs and/or acoustic parameters to generate the sound filters. The acoustic parameters describe acoustic properties of the local area. The acoustic parameters may include, e.g., a reverberation time, a reverberation level, a room impulse response, etc. In some embodiments, the sound filter module 285 calculates one or more of the acoustic parameters. In some embodiments, the sound filter module 285 requests the acoustic parameters from a mapping server (e.g., as described below with regard to FIG. 5).

The sound filter module 285 provides the sound filters to the transducer array 210. In some embodiments, the sound filters may cause positive or negative amplification of sounds as a function of frequency.

Sensor Array Optimization

Figure 3:
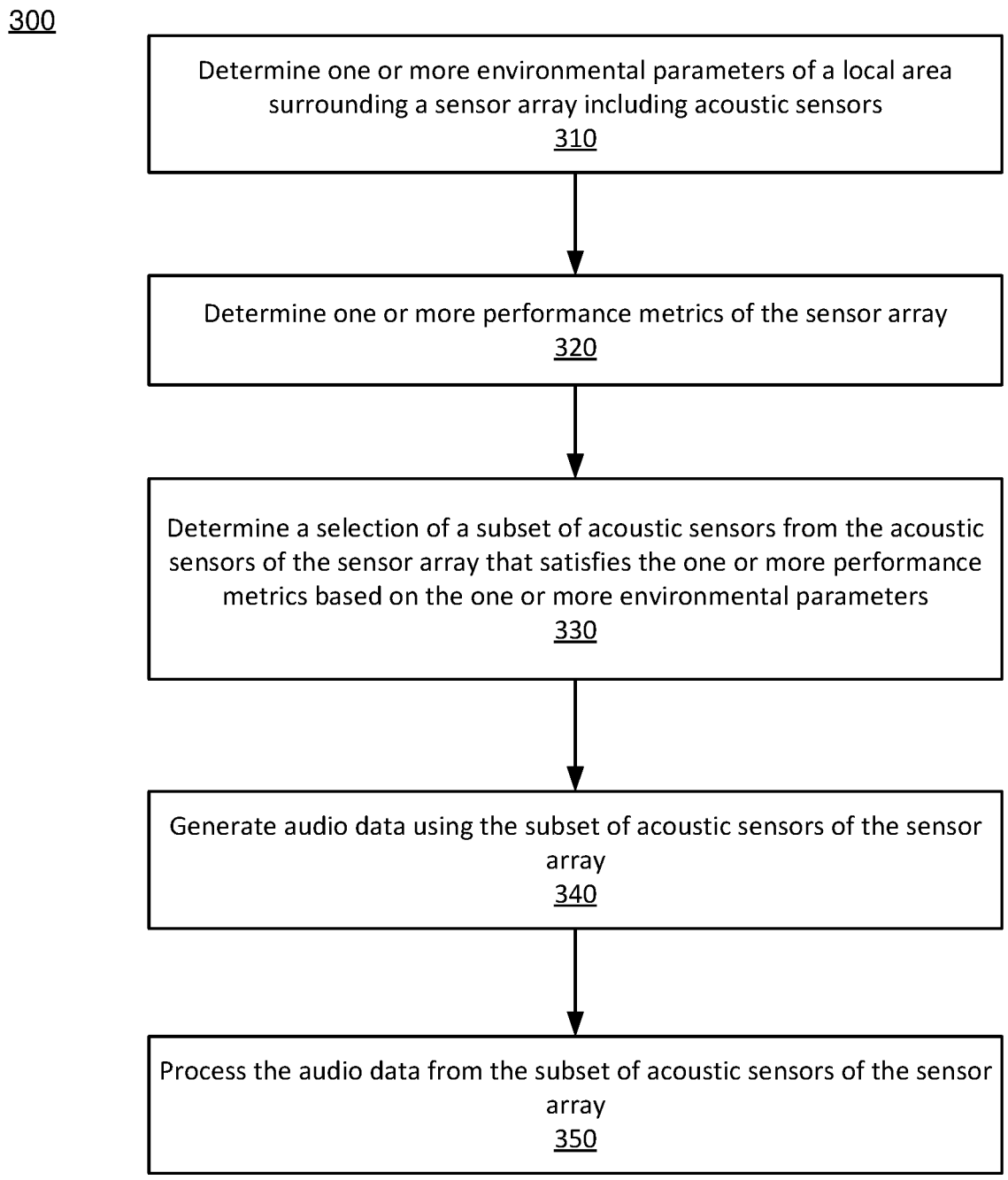
FIG. 3 is a flowchart illustrating a process of optimizing acoustic sensors on a headset, in accordance with one or more embodiments.

FIG. 3 is a flowchart illustrating a process 300 of optimizing acoustic sensors on a headset including an audio system (e.g., the audio system 200), in accordance with one or more embodiments. In one embodiment, the process of FIG. 3 is performed by components of the audio system. Other entities may perform some or all of the steps of the process in other embodiments (e.g., a console). Likewise, embodiments may include different and/or additional steps, or perform the steps in different orders.

The audio system determines 310 one or more environmental parameters of a local area surrounding a sensor array including acoustic sensors. The one or more environmental parameters may be determined by acoustic sensors of the sensor array, other types of sensors of a headset, or received from a server.

The audio system determines 320 one or more performance metrics of the sensor array. The one or more performance metrics may be defined by the audio system or by the user.

The audio system determines 330 a selection of a subset of acoustic sensors from the acoustic sensors of the sensor array that satisfies the one or more performance metrics based on the one or more environmental parameters. The audio system may associate relationships between the performance metrics and environmental parameters as inputs and subsets of acoustic sensors as outputs, and select acoustic sensors for the subset based on the relationships. By selecting an optimal subset of the acoustic sensors instead of utilizing all of the acoustic sensors of the sensor array, the audio system reduces power consumption while maintaining high performance in terms of satisfying the performance metrics. The selected set of acoustic sensors may include all of the acoustic sensors of the sensor array.

In one example, the environmental parameter of reverberation time is used to select the subset of acoustic sensors that reduces power consumption while satisfying an array gain performance metric. In some embodiments, the selection of the subset of acoustic sensors is determined by a neural network.

The audio system generates 340 audio data using the subset of acoustic sensors of the sensor array. The audio data refers to data generated by the selected subset of acoustic sensors from captured sound. In some embodiments, the audio system selectively activates and deactivates the acoustic sensors such that the selected subset of acoustic sensors is powered on and the other acoustic sensors which are not selected are powered off. Powering off some of the acoustic sensors reduces power consumption. In some embodiments, non-selected acoustic sensors are powered on and generate audio data, but do not transmit the audio data to the controller. In some embodiments, the audio data from non-selected acoustic sensors are transmitted to the controller, but are not processed by the controller. In each of these cases, power consumption of the audio system may be reduced.

The audio system processes 350 the audio data from the subset of acoustic sensors. Audio content presented by the audio system (e.g., by transducer array 210) may be based in part on the processed audio data. The processing may include performing an application of an acoustic transfer function (e.g., ATF or HRTF), a beamforming, DoA estimation, a signal enhancement, spatial filtering, or other type of processing for spatialized audio content.

The process 300 may be repeated, such as by tracking changes in environmental parameters, determining performance metrics, and selecting different subsets of the acoustic sensors based on changes in the environmental parameters or performance metrics. The process 300 may be continuously repeated as a user wearing the headset moves, such as to another location in the local area or to another local area, or as an object moves relative to the user.

Figure 4:
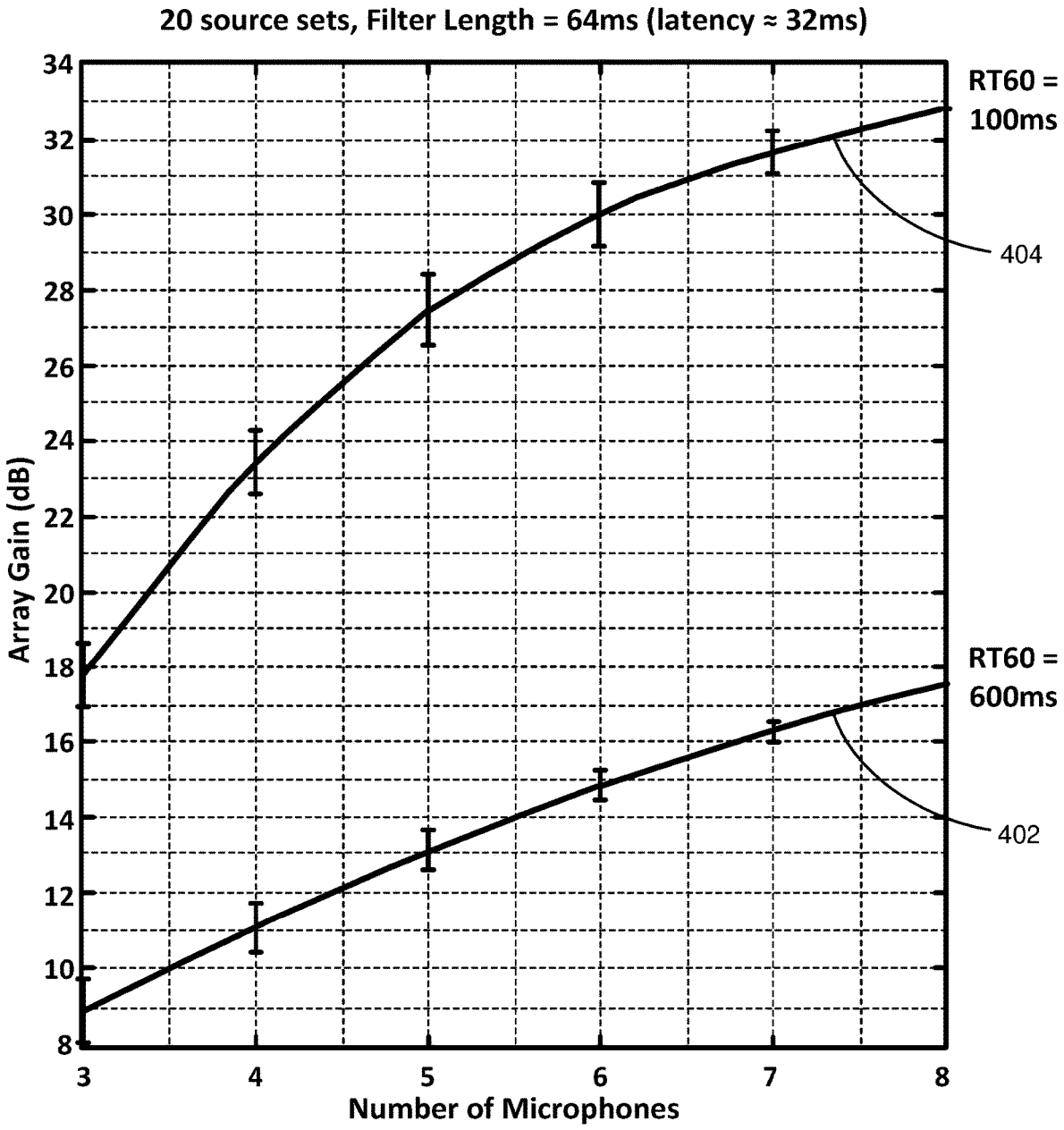
FIG. 4 is a graph illustrating the relationship between array gain and number of acoustic sensors for different reverberation times, in accordance with one or more embodiments.

FIG. 4 is a graph illustrating the relationship between array gain and number of acoustic sensors for different reverberation times, in accordance with one or more embodiments. Line 402 shows the relationship between array gain (in dB) and the number of acoustic sensors ("microphones") for a local area with a reverberation time ("RT60") of 500 ms. Line 404 shows the relationship between array gain and the number of acoustic sensors is shown for a local area with a reverberation time ("RT60") of 100 ms. A longer reverberation time generally correlates with a larger number of acoustic sensors to achieve the same amount of array gain. As such, the number of acoustic censors to achieve a target performance metric of array gain depends on the reverberation time parameter. For example, using 4 microphones results in an array gain of about 11.2 dB for the reverberation time of 500 ms and an array gain of about 23.5 dB for the reverberation time of 100 ms. Other types of environmental parameters of local areas and performance metrics include similar relationships that can inform the selection of acoustic sensors of a sensor array.

Example System Environment

Figure 5:
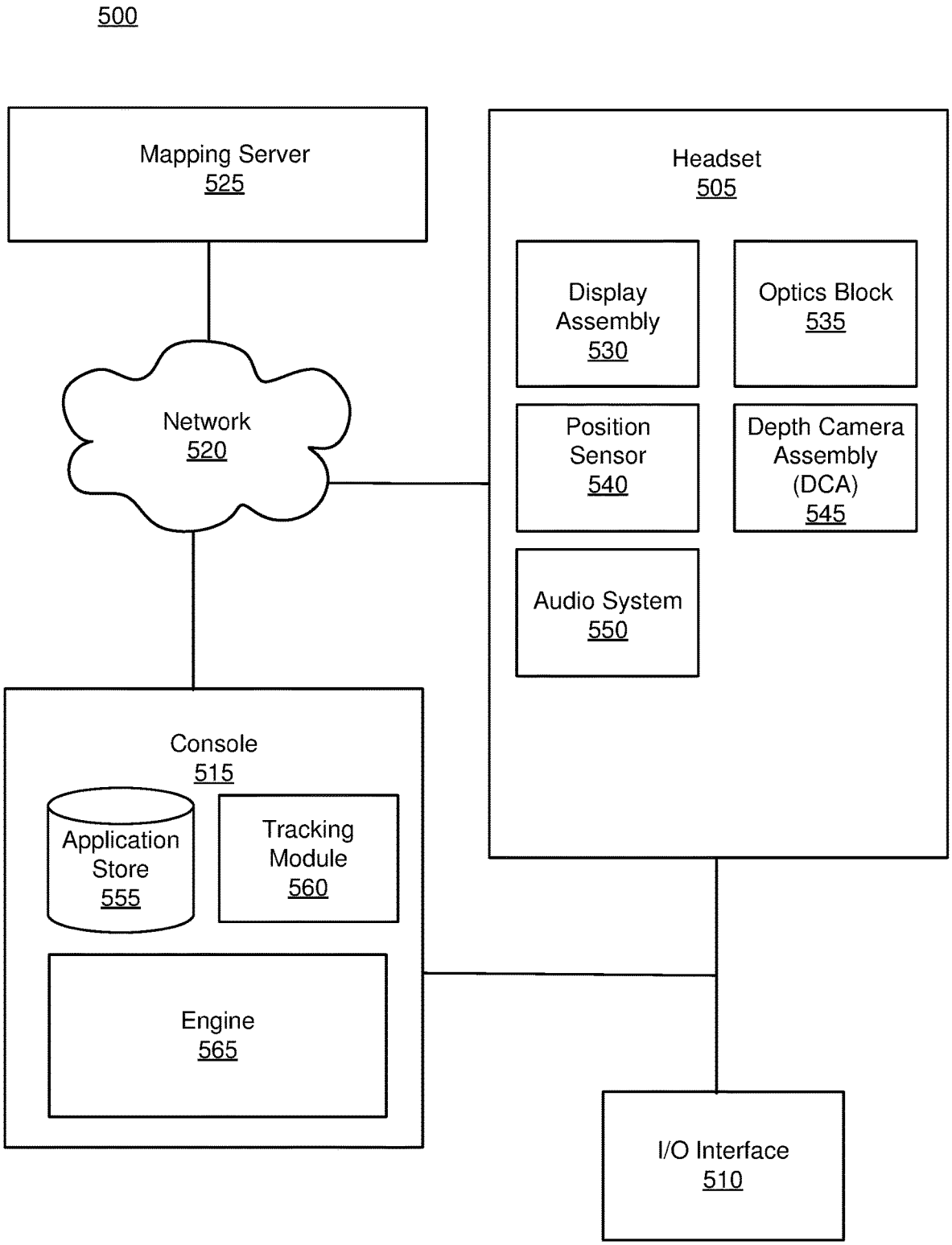
FIG. 5 is a system environment that includes a headset, in accordance with one or more embodiments.

FIG. 5 is a system 500 that includes a headset 505, in accordance with one or more embodiments. In some embodiments, the headset 505 may be the headset 100 of FIG. 1A or the headset 105 of FIG. 1B. The system 500 may operate in an artificial reality environment (e.g., a virtual reality environment, an augmented reality environment, a mixed reality environment, or some combination thereof). The system 500 shown by FIG. 5 includes the headset 505, an input/output (I/O) interface 510 that is coupled to a console 515, the network 520, and the mapping server 525. While FIG. 5 shows an example system 500 including one headset 505 and one I/O interface 510, in other embodiments any number of these components may be included in the system 500. For example, there may be multiple headsets each having an associated I/O interface 510, with each headset and I/O interface 510 communicating with the console 515. In alternative configurations, different and/or additional components may be included in the system 500. Additionally, functionality described in conjunction with one or more of the components shown in FIG. 5 may be distributed among the components in a different manner than described in conjunction with FIG. 5 in some embodiments. For example, some or all of the functionality of the console 515 may be provided by the headset 505.

The headset 505 includes the display assembly 530, an optics block 535, one or more position sensors 540, and the DCA 545. Some embodiments of headset 505 have different components than those described in conjunction with FIG. 5. Additionally, the functionality provided by various components described in conjunction with FIG. 5 may be differently distributed among the components of the headset 505 in other embodiments, or be captured in separate assemblies remote from the headset 505.

The display assembly 530 displays content to the user in accordance with data received from the console 515. The display assembly 530 displays the content using one or more display elements (e.g., the display elements 120). A display element may be, e.g., an electronic display. In various embodiments, the display assembly 530 comprises a single display element or multiple display elements (e.g., a display for each eye of a user). Examples of an electronic display include: a liquid crystal display (LCD), an organic light emitting diode (OLED) display, an active-matrix organic light-emitting diode display (AMOLED), a waveguide display, some other display, or some combination thereof. Note in some embodiments, the display element 120 may also include some or all of the functionality of the optics block 535.

The optics block 535 may magnify image light received from the electronic display, corrects optical errors associated with the image light, and presents the corrected image light to one or both eyeboxes of the headset 505. In various embodiments, the optics block 535 includes one or more optical elements. Example optical elements included in the optics block 535 include: an aperture, a Fresnel lens, a convex lens, a concave lens, a filter, a reflecting surface, or any other suitable optical element that affects image light. Moreover, the optics block 535 may include combinations of different optical elements. In some embodiments, one or more of the optical elements in the optics block 535 may have one or more coatings, such as partially reflective or anti-reflective coatings.

Magnification and focusing of the image light by the optics block 535 allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110 degrees diagonal), and in some cases all, of the user's field of view. Additionally, in some embodiments, the amount of magnification may be adjusted by adding or removing optical elements.

In some embodiments, the optics block 535 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block 535 corrects the distortion when it receives image light from the electronic display generated based on the content.

The position sensor 540 is an electronic device that generates data indicating a position of the headset 505. The position sensor 540 generates one or more measurement signals in response to motion of the headset 505. The position sensor 190 is an embodiment of the position sensor 540. Examples of a position sensor 540 include: one or more IMUS, one or more accelerometers, one or more gyroscopes, one or more magnetometers, another suitable type of sensor that detects motion, or some combination thereof. The position sensor 540 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 505 from the sampled data. For example, the IMU integrates the measurement signals received from the accelerometers over time to estimate a velocity vector and integrates the velocity vector over time to determine an estimated position of a reference point on the headset 505. The reference point is a point that may be used to describe the position of the headset 505. While the reference point may generally be defined as a point in space, however, in practice the reference point is defined as a point within the headset 505.

The DCA 545 generates depth information for a portion of the local area. The DCA includes one or more imaging devices and a DCA controller. The DCA 545 may also include an illuminator. Operation and structure of the DCA 545 is described above with regard to FIG. 1A.

The audio system 550 provides audio content to a user of the headset 505. The audio system 550 is substantially the same as the audio system 200 describe above. For example, the audio system 550 optimizes the selection of acoustic sensors of a sensor array based on environmental parameters and target performance metrics. The audio system 550 may comprise one or acoustic sensors, one or more transducers, and an audio controller. The audio system 550 may provide spatialized audio content to the user. In some embodiments, the audio system 550 may request acoustic parameters from the mapping server 525 over the network 520. The acoustic parameters describe one or more acoustic properties (e.g., room impulse response, a reverberation time, a reverberation level, etc.) of the local area. The audio system 550 may provide information describing at least a portion of the local area from e.g., the DCA 545 and/or location information for the headset 505 from the position sensor 540. The audio system 550 may generate one or more sound filters using one or more of the acoustic parameters received from the mapping server 525, and use the sound filters to provide audio content to the user.

The I/O interface 510 is a device that allows a user to send action requests and receive responses from the console 515. An action request is a request to perform a particular action. For example, an action request may be an instruction to start or end capture of image or video data, or an instruction to perform a particular action within an application. The I/O interface 510 may include one or more input devices. Example input devices include: a keyboard, a mouse, a game controller, or any other suitable device for receiving action requests and communicating the action requests to the console 515. An action request received by the I/O interface 510 is communicated to the console 515, which performs an action corresponding to the action request. In some embodiments, the I/O interface 510 includes an IMU that captures calibration data indicating an estimated position of the I/O interface 510 relative to an initial position of the I/O interface 510. In some embodiments, the I/O interface 510 may provide haptic feedback to the user in accordance with instructions received from the console 515. For example, haptic feedback is provided when an action request is received, or the console 515 communicates instructions to the I/O interface 510 causing the I/O interface 510 to generate haptic feedback when the console 515 performs an action.

The console 515 provides content to the headset 505 for processing in accordance with information received from one or more of: the DCA 545, the headset 505, and the I/O interface 510. In the example shown in FIG. 5, the console 515 includes an application store 555, a tracking module 560, and an engine 565. Some embodiments of the console 515 have different modules or components than those described in conjunction with FIG. 5. Similarly, the functions further described below may be distributed among components of the console 515 in a different manner than described in conjunction with FIG. 5. In some embodiments, the functionality discussed herein with respect to the console 515 may be implemented in the headset 505, or a remote system.

The application store 555 stores one or more applications for execution by the console 515. An application is a group of instructions, that when executed by a processor, generates content for presentation to the user. Content generated by an application may be in response to inputs received from the user via movement of the headset 505 or the I/O interface 510. Examples of applications include: gaming applications, conferencing applications, video playback applications, or other suitable applications.

The tracking module 560 tracks movements of the headset 505 or of the I/O interface 510 using information from the DCA 545, the one or more position sensors 540, or some combination thereof. For example, the tracking module 560 determines a position of a reference point of the headset 505 in a mapping of a local area based on information from the headset 505. The tracking module 560 may also determine positions of an object or virtual object. Additionally, in some embodiments, the tracking module 560 may use portions of data indicating a position of the headset 505 from the position sensor 540 as well as representations of the local area from the DCA 545 to predict a future location of the headset 505. The tracking module 560 provides the estimated or predicted future position of the headset 505 or the I/O interface 510 to the engine 565.

The engine 565 executes applications and receives position information, acceleration information, velocity information, predicted future positions, or some combination thereof, of the headset 505 from the tracking module 560. Based on the received information, the engine 565 determines content to provide to the headset 505 for presentation to the user. For example, if the received information indicates that the user has looked to the left, the engine 565 generates content for the headset 505 that mirrors the user's movement in a virtual local area or in a local area augmenting the local area with additional content. Additionally, the engine 565 performs an action within an application executing on the console 515 in response to an action request received from the I/O interface 510 and provides feedback to the user that the action was performed. The provided feedback may be visual or audible feedback via the headset 505 or haptic feedback via the I/O interface 510.

The network 520 couples the headset 505 and/or the console 515 to the mapping server 525. The network 520 may include any combination of local area and/or wide area networks using both wireless and/or wired communication systems. For example, the network 520 may include the Internet, as well as mobile telephone networks. In one embodiment, the network 520 uses standard communications technologies and/or protocols. Hence, the network 520 may include links using technologies such as Ethernet, 802.11, worldwide interoperability for microwave access (WiMAX), 2G/3G/4G mobile communications protocols, digital subscriber line (DSL), asynchronous transfer mode (ATM), InfiniBand, PCI Express Advanced Switching, etc. Similarly, the networking protocols used on the network 520 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 520 can be represented using technologies and/or formats including image data in binary form (e.g. Portable Network Graphics (PNG)), hypertext markup language (HTML), extensible markup language (XML), etc. In addition, all or some of links can be encrypted using conventional encryption technologies such as secure sockets layer (SSL), transport layer security (TLS), virtual private networks (VPNs), Internet Protocol security (IPsec), etc.

The mapping server 525 may include a database that stores a virtual model describing a plurality of spaces, wherein one location in the virtual model corresponds to a current configuration of a local area of the headset 505. The mapping server 525 receives, from the headset 505 via the network 520, information describing at least a portion of the local area and/or location information for the local area. The mapping server 525 determines, based on the received information and/or location information, a location in the virtual model that is associated with the local area of the headset 505. The mapping server 525 determines (e.g., retrieves) one or more acoustic parameters associated with the local area, based in part on the determined location in the virtual model and any acoustic parameters associated with the determined location. The mapping server 525 may transmit the location of the local area and any values of acoustic parameters associated with the local area to the headset 505. In some embodiments, the mapping server 525 provides one or more environmental parameters used by the audio system 550 to optimize power consumption associated with the sensor array to the headset 505.

Additional Configuration Information

The foregoing description of the embodiments has been presented for illustration; it is not intended to be exhaustive or to limit the patent rights to the precise forms disclosed. Persons skilled in the relevant art can appreciate that many modifications and variations are possible considering the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A method, comprising, by an audio system including a sensor array:

determining an environmental parameter of a local area surrounding the sensor array, the sensor array including acoustic sensors configured to detect sounds in the local area;

determining a performance metric for the sensor array;

determining a selection of a subset of acoustic sensors from the acoustic sensors of the sensor array that satisfies the performance metrics based on the environmental parameter of the local area, the subset of acoustic sensors including a minimum number of acoustic sensors that satisfies the performance metric as determined from the environmental parameter; and processing audio data from the subset of the acoustic sensors of the sensor array, wherein audio content presented by the audio system is based in part on the processed audio data.

2. The method of claim 1, further comprising activating the subset of acoustic sensors.

3. The method of claim 2, further comprising deactivating acoustic sensors of the sensory array that are outside of the subset.

4. The method of claim 2, wherein a first acoustic sensor of the sensor array is outside of the subset and the first acoustic sensor is active, the method further comprising:

removing audio data produced by the first acoustic sensor from audio data generated by the sensor array to form the audio data of the subset.

5. The method of claim 1, wherein:

the environmental parameter includes a reverberation time; and the performance metric includes an array gain.

6. The method of claim 1, wherein the environmental parameter includes one of:

a number of acoustic sound sources;

a location of a sound source;

a direction of arrival of a sound source;

loudness of background noise; or a spatial property of background noise.

7. The method of claim 1, wherein processing the audio data includes performing at least one of:

an application of an acoustic transfer function;

a beamforming;

a direction of arrival estimation;

a signal enhancement; or a spatial filtering.

8. The method of claim 1, wherein the performance metric includes one of:

a word error rate;

an array gain;

a distortion threshold level;

a signal to noise ratio;

white noise gain;

signal to noise ratio of a beamformer;

a distance for sound pick-up;

speech quality;

speech intelligibility; or listening effort.

9. The method of claim 1, wherein determining the selection of the subset of acoustic sensors from the acoustic sensors of the sensor array that satisfies the performance metric based on the environmental parameter further comprises:

using a neural network defining relationships between inputs including environmental parameters and performance metrics and outputs including subsets of the acoustic sensors of the sensor array.

10. The method of claim 1, further comprising receiving the environmental parameter from a server based on a location associated with the sensor array.

11. The method of claim 1, further comprising receiving the performance metric from a headset including another sensor array.

12. The method of claim 1, further comprising updating the subset of acoustic sensors based on a change in the environmental parameter.

13. A system, comprising:

a sensor array including acoustic sensors configured to detect sound in a local area; and processing circuitry configured to:

determine an environmental parameter of the local area;

determine a performance metric for the sensor array;

determine a selection of a subset of acoustic sensors from the acoustic sensors of the sensor array that satisfies the performance metric based on the environmental parameter of the local area, the subset of acoustic sensors including a minimum number of acoustic sensors that satisfies the performance metric as determined from the environmental parameter; and process audio data from the subset of the acoustic sensors of the sensor array wherein audio content presented by the system is based in part on the processed audio data.

14. The system of claim 13, wherein the processing circuitry is further configured to activate the subset of acoustic sensors.

15. The system of claim 14, wherein the processing circuitry is further configured to deactivate acoustic sensors of the sensory array that are outside of the subset.

16. The system of claim 14, wherein a first acoustic sensor of the sensor array is outside of the subset and the first acoustic sensor is active, and the processing circuitry is further configured to:

remove audio data produced by the first acoustic sensor from audio data generated by the sensor array to form the audio data of the subset.

17. The system of claim 13, wherein:

the environmental parameter includes a reverberation time; and the performance metric includes an array gain.

18. The system of claim 13, wherein:

the environmental parameter includes one of:

a number of acoustic sound sources;

a location of a sound source;

a direction of arrival of a sound source;

loudness of background noise; or a spatial property of background noise; and the processing circuitry configured to process the audio data includes the audio controller being configured to perform at least one of:

an application of an acoustic transfer function;

a beamforming;

a direction of arrival estimation;

a signal enhancement; or a spatial filtering.

19. The system of claim 13, wherein the performance metric includes:

a word error rate;

an array gain;

a distortion threshold level;

a signal to noise ratio;

white noise gain;

signal to noise ratio of a beamformer;

a distance for sound pick-up speech quality;

speech intelligibility; or listening effort.

20. A non-transitory computer-readable medium storing instructions that, when executed by one or more processors, cause the one or more processors to:

determine an environmental parameter of a local area surrounding a sensor array, the sensor array including acoustic sensors configured to detect sounds in the local area;

determine a performance metric for the sensor array;

determine a selection of a subset of acoustic sensors from the acoustic sensors of the sensor array that satisfies the performance metric based on the environmental parameter of the local area, the subset of acoustic sensors including a minimum number of acoustic sensors that satisfies the performance metric as determined from the environmental parameter; and process audio data from the subset of the acoustic sensors of the sensor array.

* * * * *